United States Patent [19]

Kobayashi et al.

[11] Patent Number: 4,538,649

[45] Date of Patent: Sep. 3, 1985

[54] WEFT PICKING DEVICE OF AIR JET TYPE WEAVING LOOM

[75] Inventors: Yasushi Kobayashi, Kokubunji; Hidetsugu Umezawa, Higashiyamoto, both of Japan

[73] Assignee: Nissan Motor Co., Ltd., Yokohama, Japan

[21] Appl. No.: 562,730

[22] Filed: Dec. 19, 1983

[30] Foreign Application Priority Data

Dec. 22, 1982 [JP] Japan ..... 57-223877
Aug. 19, 1983 [JP] Japan ..... 58-150129

[51] Int. Cl.[3] ..... D03D 47/30
[52] U.S. Cl. ..... 139/435
[58] Field of Search ..... 139/435; 226/97

[56] References Cited

U.S. PATENT DOCUMENTS 3,847,187 11/1974 Buran et al. ..... 139/435
4,125,133 11/1978 Kobayashi ..... 139/435
4,190,067 2/1980 Kuda et al. ..... 139/435
4,314,590 2/1982 Suzuki et al. ..... 139/435

FOREIGN PATENT DOCUMENTS 2370811 10/1977 France ..... 139/435
53-11590 4/1978 Japan .

OTHER PUBLICATIONS

European Search Report.

*Primary Examiner*—Henry S. Jaudon
*Attorney, Agent, or Firm*—Schwartz, Jeffery, Schwaab, Mack, Blumenthal & Evans

[57] ABSTRACT

The row of air guide members comprises a nozzle-mounted air guide member having around the air guide opening a plurality of air ejection holes, a first group of air guide members located downstream of the nozzle-mounted member and positioned between the nozzle-mounted member and the point at or about which the inboard boundary of the auxiliary air flow from each air ejection hole intersects the axis of the air guide channel of the row of the air guide members, and a second group of air guide members located downstream of the first group of air guide members. The air guide openings of the first group guide members are larger than the air guide opening of the nozzle-mounted member and gradually reduced in diameter with increase of distance from the nozzle-mounted member. The air guide openings of the second group members are identical to each other and to the air guide opening of the nozzle-mounted air guide member.

20 Claims, 13 Drawing Figures

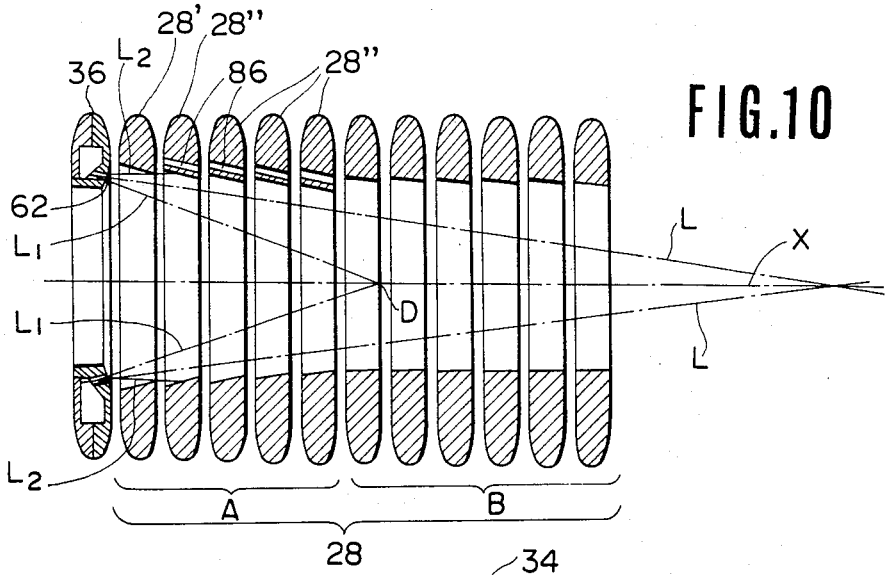
FIG.10
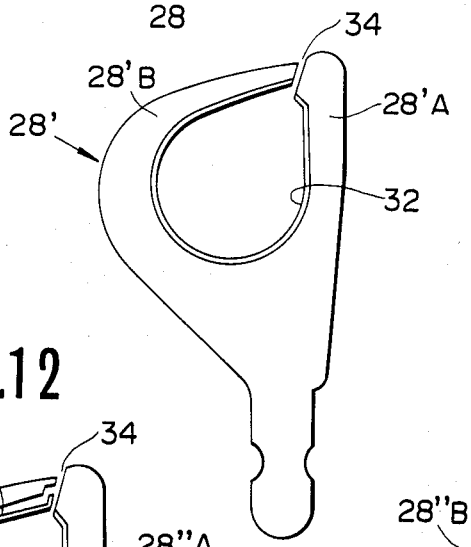
FIG.11
FIG.12
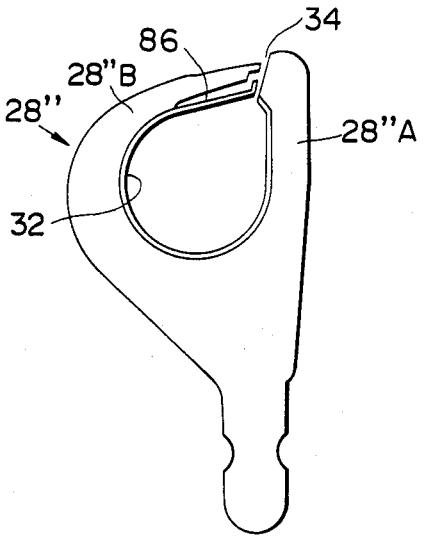
FIG. 13
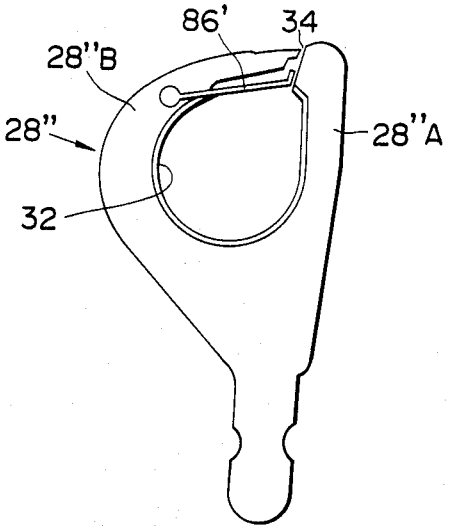

WEFT PICKING DEVICE OF AIR JET TYPE WEAVING LOOM

BACKGROUND OF THE INVENTION

1. Field of the Invention

The present invention relates in general to a weft picking device of an air jet type weaving loom, and more particularly to a weft picking device of the type which comprises a row of air guide members, a main nozzle, and auxiliary nozzles associated with some of the air guide members to assist the weft picking operation.

2. Description of the Prior Art

In an air jet type weaving loom, there is known a so-called "sub-nozzle type weft picking device" which comprises generally a row of closed type air guide members by which the weft carrying air guide channel is defined, a main nozzle from which compressed air is ejected to eject the weft yarn into the air guide channel, and auxiliary nozzles associated with some of the air guide members to eject auxiliary air into the air guide channel to assist the weft picking operation. The aligned air guide members form an axially extending slot through which the picked weft yarn in the air guide channel passes out upon beating operation of the loom. For providing the air guide channel and the slot, each air guide member has therein an air guide opening which forms a part of the air guide channel, and a slit which is connected to the air guide opening and forms a part of the axially extending slot.

As is known, the sub-nozzle type weft picking device as mentioned above has exhibited excellent weft picking function as compared with a single nozzle type weft picking device which is not provided with the auxiliary nozzles corresponding to the auxiliary nozzles of the sub-nozzle type weft picking. device. However, as will become apparent as the description proceeds, even in such sub-nozzle type weft picking device, it is difficult to continuously carry out perfect weft picking because of inherency of employing the auxiliary nozzles.

SUMMARY OF THE INVENTION

According to the present invention, there is provided a weft picking device of an air jet type weaving loom, which comprises a plurality of air guide members which are aligned in the weft picking direction, each guide member having therein both a frusto-conical air guide opening through which the weft yarn passes upon picking, and a slit through which the weft yarn passes out upon beating, the tapered surface of the air guide opening of each air guide member being tapered toward the weft picking direction, the weft picking device comprising a nozzle-mounted air guide member having around the air guide opening thereof a plurality of air ejection holes from which compressed air is ejected in the weft picking direction to establish an auxiliary air flow; a first group of air guide members located downstream of the nozzle-mounted air guide member and positioned between the nozzle-mounted air guide member and the point at or about which the inboard boundary of the auxiliary air flow from each air ejection hole intersects the axis of the air guide channel of the aligned air guide members, the air guide openings of the first group air guide members being larger than the air guide opening of the nozzle-mounted air guide member and gradually reduced in diameter as the distance from the nozzle-mounted air guide member increases; and a second group of air guide members located downstream of the first group of air guide members, the air guide openings of the second group air guide members being identical to each other and to the air guide opening of the nozzle-mounted air guide member.

BRIEF DESCRIPTION OF THE DRAWINGS

Objects and advantages of the present invention will become apparent from the following description when taken in conjunction with the accompanying drawings, in which:

FIG. 10 is a sectional view similar to FIG. 7, but showing a third embodiment of the present invention; and FIGS. 11, 12 and 13 are respective front views of different air guide members employed in the third embodiment of FIG. 10.

DESCRIPTION OF SUB-NOZZLE TYPE WEFT PICKING DEVICE

Figure 1:
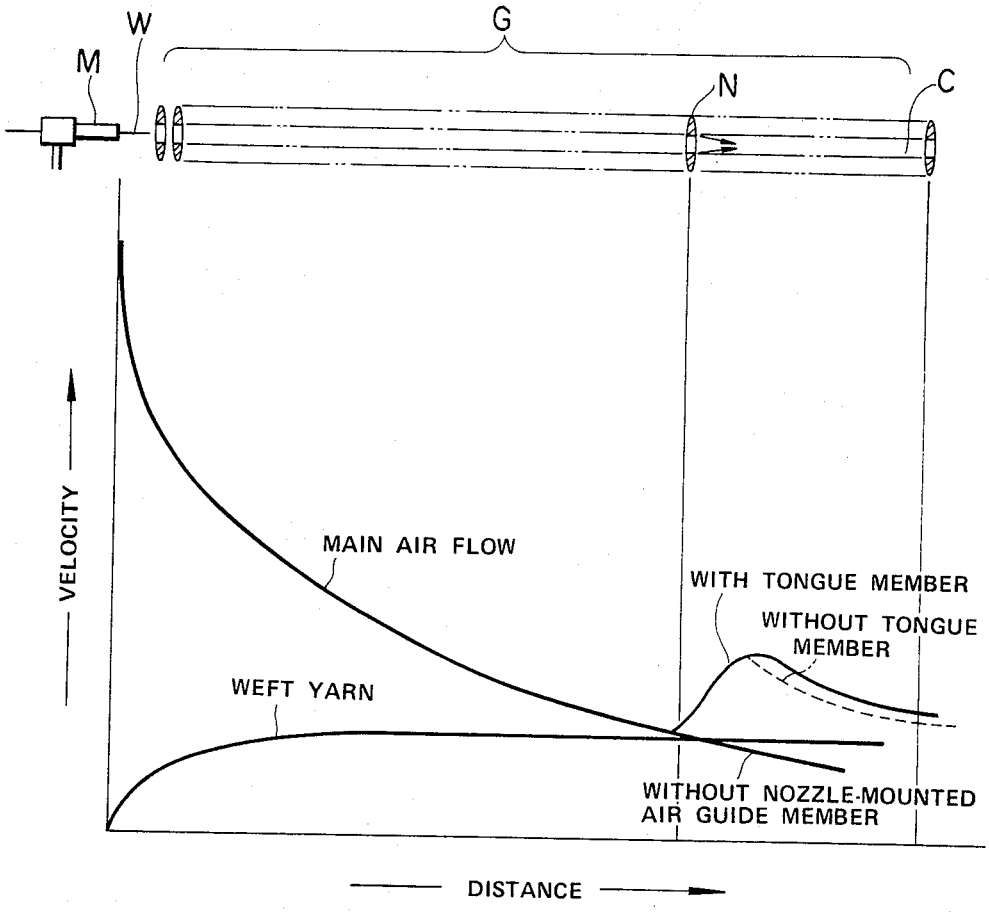
FIG. 1 is an explanatory diagram showing the principle of the sub-nozzle type weft picking device.

Prior to describing in detail the invention, a so-called "sub-nozzle type weft picking device" will be outlined with reference to FIG. 1 in order to clarify the background of the invention.

In FIG. 1, there is schematically shown the sub-nozzle type weft picking device together with a graph illustrating the respective velocities of the main air flow and the weft yarn W with respect to the distance from the main nozzle M. Some of the aligned air guide members G located remote from the main nozzle M are provided with auxiliary nozzles to form the nozzle-mounted air guide members N. For facilitation of the drawing, only the upstreammost positioned nozzle-mounted air guide member is illustrated. Auxiliary air is ejected from the auxiliary nozzles in the downstream direction into the air guide channel C of the air guide members G to assist the air flow which is mainly produced by the main nozzle M. As may be seen from the graph, usually, the nozzle-mounted air guide member N is located at or adjacent the position where the velocity of the main air flow becomes less than that of the weft yarn W. With the auxiliary air thus applied to the main air flow at that position, the velocity of the main air flow is increased thereby to keep the weft traction operation of the main air flow in a sufficient level.

In the sub-nozzle type weft picking device as mentioned hereinabove, it is important but difficult to effectively join the auxiliary air flow with the main air flow. In fact, the join of the auxiliary air flow with the main air flow is carried out under the influence of not only the main air flow per se, but also the induction function possessed by the air guide opening of each air guide member. Thus, if the influence by the air guide opening is remarkable, that is, when the auxiliary air flow is joined with the main air flow at a marked angled to the axis of the air guide opening, the auxiliary air flow acts inevitably as a so-called air curtain against the main air flow thereby disturbing the travelling of the weft carrying air flow. When, on the contrary, the auxiliary air flow is joined with the main air flow at a less angle to the axis of the air guide opening, the weft traction force possessed by the main air flow in the air guide channel is reduced remarkably. Under these conditions, desired weft picking is not effected. The present invention is provided by taking the above-mentioned matters into consideration.

DETAILED DESCRIPTION OF THE INVENTION

Figure 2:
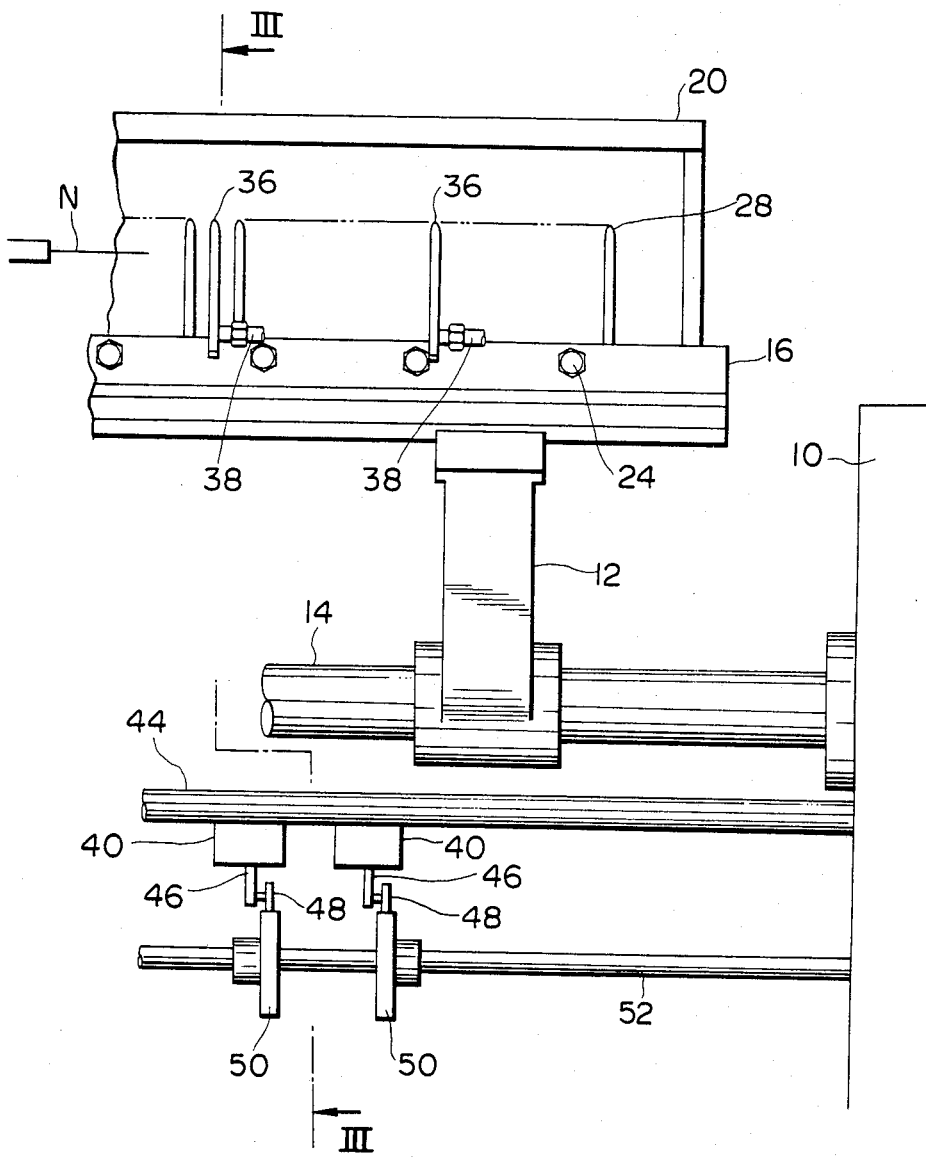
FIG. 2 is a front view of an essential part of the weft picking device of a first embodiment of the present invention.
Figure 3:
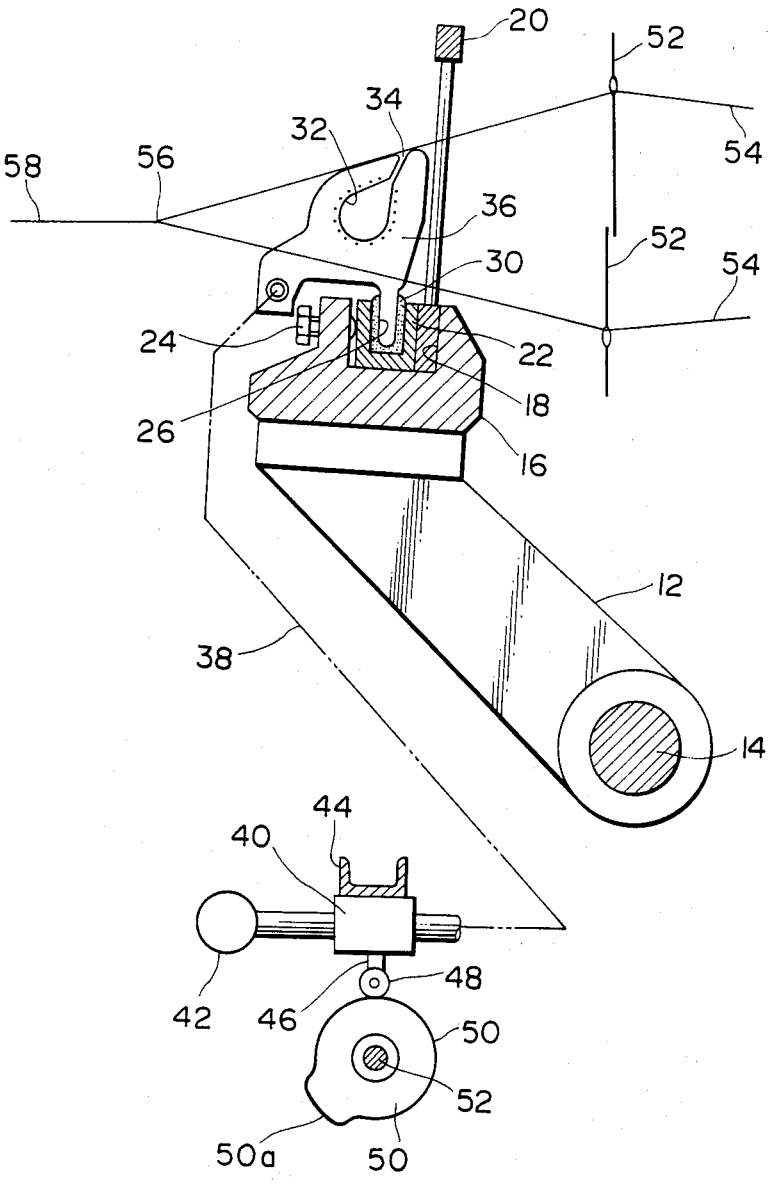
FIG. 3 is a sectional view taken along the line III—III of FIG. 2.

Referring to FIGS. 2 and 3, there is shown an essential part of the weft picking device which is a first embodiment of the present invention. Designated by numeral 10 is a frame of the loom. A plurality of slays 12 are mounted on a slay sword shaft 14 supported by the frame 10. A reed holder 16 is fixed to the upper ends of the slays 12. The reed holder 16 is formed with a groove 18 (see FIG. 3) into which both a lower frame of a reed 20 and an air guide member holder 22 are received, which are secured thereto by means of bolts 24. Into a groove 26 formed in the air guide member holder 22 are received base portions of air guide members 28. The air guide members 28 are arranged in the weft picking direction at evenly spaced intervals and bonded to the air guide member holder 22 by means of adhesive material 30. Each of the air guide members 28 comprises a straight arm and a curved arm by which a frusto-conical air guide opening 32 is defined leaving a slit 34 defined between the leading ends of the arms. As is clear hereinafter, the air guide opening 32 is tapered toward the weft picking direction and forms a part of the air guide channel of the aligned air guide members 28 through which the weft carrying air flows for conveying the weft yarn W, while, the slit 34 forms a part of the axially extending slot of the aligned air guide members through which the picked weft yarn W in the air guide channel passes out upon beating operation.

Some of the aligned air guide members 28 located remote from the main nozzle M are provided with auxiliary nozzles or air ejection holes to form the so-called auxiliary nozzle-mounted air guide members 36. These air guide members 36 are arranged at suitably spaced intervals in the row of the air guide members 28.

As is seen from FIG. 3, to the nozzle-mounted air guide members 36 is connected a flexible pipe 38 which extends through a valve 40 to a compressed air supply source 42. The valve 40 is fixed to a stay 44 supported by the frame 10. The valve 40 has a valve plunger 46 which carries thereon a cam follower 48. The follower 48 runs on the periphery of a cam 50 which is fixed to a rotating shaft 52 rotatable simultaneously with the main shaft of the loom. The valve 40 assumes its open position when the cam follower 48 rides on the higher portion **50*a* of the cam 50, and assumes its close position when the cam follower 48 runs along the lower portion 50*b* of the cam 50. As may be seen from FIG. 2, each nozzle-mounted air guide member 36 is connected to its own valve 40**.

Numeral 52 denotes the heddles, 54 the warp yarns, 56 the cloth fell and 58 denotes the woven cloth produced.

Figure 5:
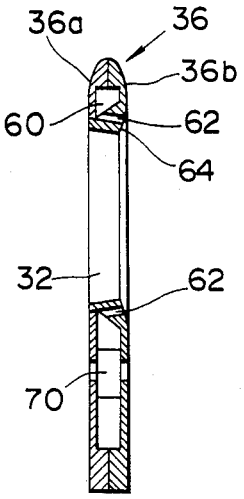
FIG. 5 is a sectional view taken along the line V—V of FIG. 4.
Figure 6:
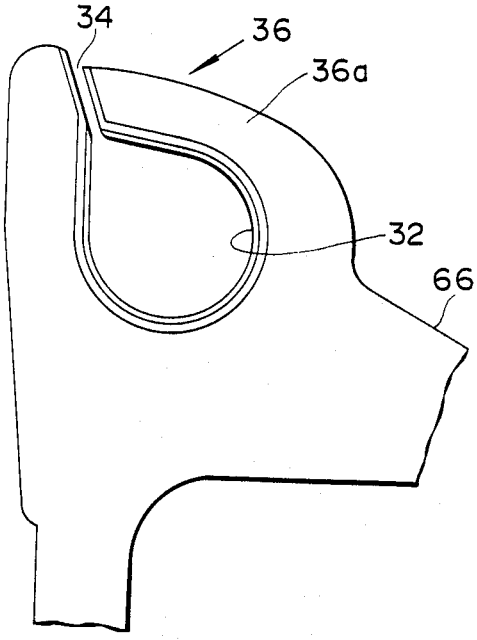
FIG. 6 is a back view of the nozzle-mounted air guide member of FIG. 4.

In the following, detailed construction of the nozzle-mounted air guide member 36 will be described with reference to FIGS. 4, 5 and 6. The nozzle-mounted air guide member 36 has, similar to the conventional nozzle-less air guide members 28, a straight arm and a curved arm by which an air guide opening 32 is defined leaving a slit 34 between the leading ends of the arms. However, unlike the conventional air guide members 28, the nozzle-mounted air guide member 36 has a dividable construction which consists of an upstream located section **36*a* and a downstream located section 36*b* which are welded to each other. (Of course, monoblock type nozzle-mounted air guide member formed by for example "lost-wax" casting may be employed as the member 36.) The downstream located section 36*b* forms therein the tapered or frusto-conical air guide opening 32. As is seen from FIG. 5, each of the sections 36*a* and 36*b* has a recessed construction so that upon assembly of them, there is formed an enclosed space or air passage 60 in the assembled air guide member 36**.

The downstream located section **36*b* is formed, at the area surrounding the frusto-conical air guide opening 32, with a plurality of auxiliary nozzles or air ejection holes 62 which are arranged at evenly spaced intervals. As is seen from FIG. 5, these air ejection holes 62 are connected to the air passage 60 and inclined to focus at a downstream given point on the axis X of the air guide opening 32. Furthermore, the downstream located section 36*b* is formed, at the downstream facing surface surrounding the smallest diameter portion of the fursto-conical air guide opening 32, with a tapered semi-circular surface 64 to which the inclined air ejection holes 62 are exposed. Preferably, the tapered surface 64 is inclined at generally right angles with respect to the axes of the air ejection holes 62. It is not always necessary to provide such tapered surface 64 throughout the entire periphery of the air guide opening 32, that is to say, it is also possible in the invention to provide a tapered circular surface at only the limited portion at the exist of each air ejection hole 62**.

Figure 4:
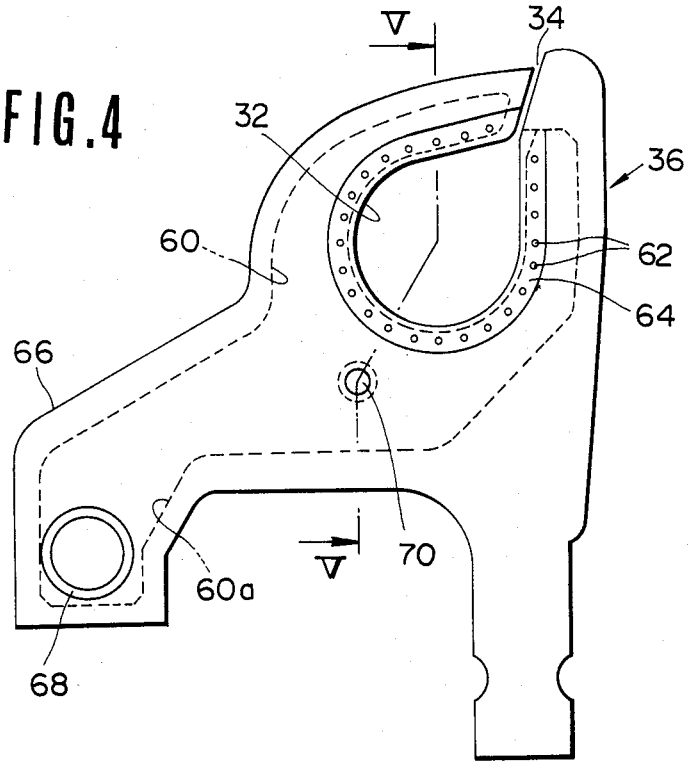
FIG. 4 is a front view of a nozzle-mounted air guide member employed in the first embodiment of the present invention.

As is seen from FIG. 4, the nozzle-mounted air guide member 36 has an extension 66 which forms therein an enclosed space **60*a* merged with the air passage 60. The leading end portion of the extension 66 is equipped with a connecting tube 68 welded thereto. The tube 68 extends perpendicular to the direction in which the extension 66 extends. The interior of the connecting tube 68 is connected to the air passage 60 of the nozzle-mounted air guide member 36 through an opening or openings formed in the tube 68 at the portion enclosed by the extension 66. The afore-mentioned flexible pipe 38 is connected to the tube 68, so that upon weft picking, the compressed air from the compressed air supply source 42 is applied to the air passage 60 of the nozzle-mounted air guide member 36 at a given timing and thus ejected from the air ejection holes 62. Within the air passage 60 of the air guide member 36, a stud 70 is arranged which spans between the upstream and downstream located sections 36*a* and 36*b* to connect them. Preferably, the stud 70 is positioned in the junction portion between the circular air passage surrounding the air guide opening 32 and the air passage 60***a* formed in the extension 66.

In the following, the other guide members 28 which are arranged downstream of the nozzle-mounted air guide member 36 will be described with reference to FIG. 7.

Figure 7:
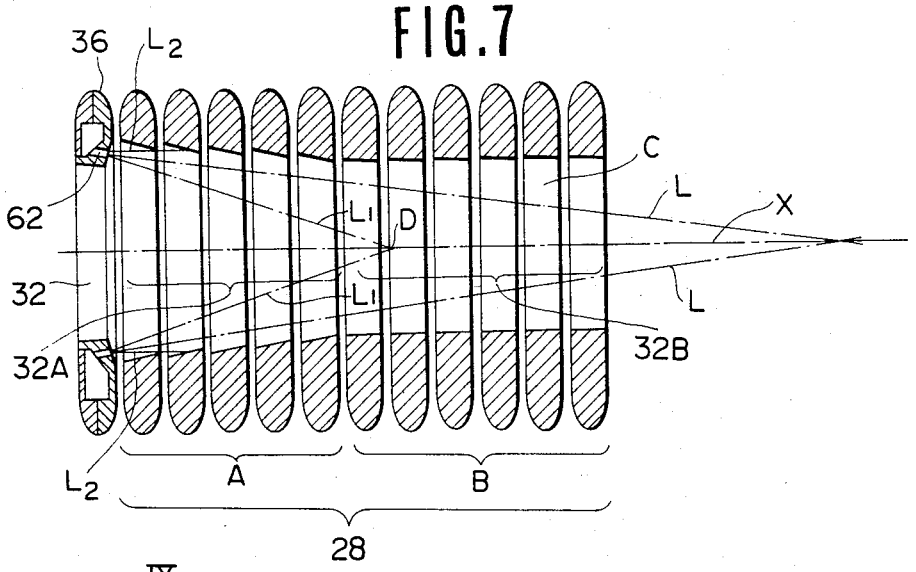
FIG. 7 is a sectional view of a row of air guide members employed in the first embodiment of the present invention.

As will be seen from FIG. 7, the guide members 28 consist of two groups of guide members A and B, the group A being located just downstream of the nozzle-mounted air guide member 36, while, the group B being located downstream of the group A. The guide members of group A are located between the nozzle-mounted air guide member 36 and the point D at or about which the inboard boundary $L_1$ of the auxiliary air flow from each nozzle 62 intersects the axis X of the air guide channel C. The air guide members of group A each have frusto-conical air guide openings which are larger than the air guide opening 32 of the nozzle-mounted air guide member 36 and are gradually reduced in diameter as the distance from the guide member 36 increases. The air guide opening of the upstream-most located guide member of group A is sufficiently larger than that of the nozzle-mounted guide member 36 so that it covers the nozzles 62 of the nozzle-mounted air guide member 36. The tapered surfaces defining the perimeters of the frusto-conical air guide openings of the group A air guide members are generally parallel with the trajectory line L along which the auxiliary air flow from each nozzle 62 is directed. The angle of each tapered surface of the group A member with respect to the axis X of the air guide channel C is greater than that of the nozzle-mounted air guide member 36. If desired, two or three guide members of group A located just downstream of the nozzle-mounted air guide member 36 may have identical air guide openings. Designated reference $L_2$ is the outboard boundary of the auxiliary air flow ejected from each nozzle 62.

The air guide members of group B are located downstream of the group A and each have identical frusto-conical air guide openings which are smaller in diameter than the smallest air guide opening of the group A guide members, but identical to the air guide opening 32 of the nozzle-mounted air guide member 36. The air guide members of group B extend to another nozzle-mounted air guide member (not shown) located downstream of the guide member 36 or to the terminal guide member of the row of the air guide members 28.

In the following, operation will be described.

Upon picking operation, the weft yarn W is driven into the air guide channel C by air jet ejected from the main nozzle M and runs downstreamly in the channel C with the air flow running in the same.

Just before the time when the leading end of the weft yarn W reaches the nozzle-mounted air guide member 36, the higher portion 50*a* of the cam 50 comes into engagement with the cam follower 48 and lifts up the valve plunger 46 to open the valve 40 with the result that compressed air is ejected from the auxiliary nozzles or air ejection holes 62 of the nozzle-mounted air guide member 36. During this, the compressed air from the air source 42 flows in the air passage 60 of the guide member 36 in the direction from the extension 66 toward the air ejection holes 62. With the stud 70 located in the air passage 60, the distribution of air flow in the air passage 60 is effectively and assuredly achieved. The air ejected from the auxiliary nozzles 62 is joined, in the guide openings 32A and 32B of the air guide members of groups A and B, with the main air flow issued from the main nozzle M thereby to increase the velocity of the weft carrying air flow.

During this operation, because the air guide openings 32A of the group A guide members are larger than that of the nozzle-mounted guide member 36 and the tapered surfaces of the air guide openings of the group A guide members are generally parallel with the trajectory line L along which the air flow from each nozzle 62 is directed, the air ejection from the nozzles 62 is smoothly achieved without being severely affected by the guide openings 32A of the group A guide members. That is to say, with the trajectory line L making no contact with the tapered surfaces of the adjacent air guide members, only the outboard boundary $L_2$ of the air flow from each nozzle 62 is affected by such tapered surfaces. In fact, the impingement of the outboard boundary $L_2$ of the auxiliary air flow upon the tapered surfaces of the air guide members of group A tends to produce air diffusion from the clearances defined between the adjacent guide members. However, ejection of compressed air from each auxiliary nozzle 62 produces a stream of air from outside of the air guide members into the air guide channel C through not only the above-mentioned clearances but also the slits 34 of the air guide members per se. Thus, the undesirable air diffusion tendency is cancelled. At the zone downstream of the point D where the inboard boundary $L_1$ of the air flow from each auxiliary nozzle 62 intersects the axis X of the air guide channel C, the disturbance of the main air flow which would otherwise occur due to the joint of the auxiliary air flow with the main air flow is minimized because of the presence of the air guide members of group B. In fact, the identical air guide openings 32B of group B members function to positively guide the main air flow as well as the reflected air flow thereby to stabilize the weft carrying air flow in the air guide channel C. With these operations, the weft picking operation is smoothly and assuredly carried out.

Figure 8:
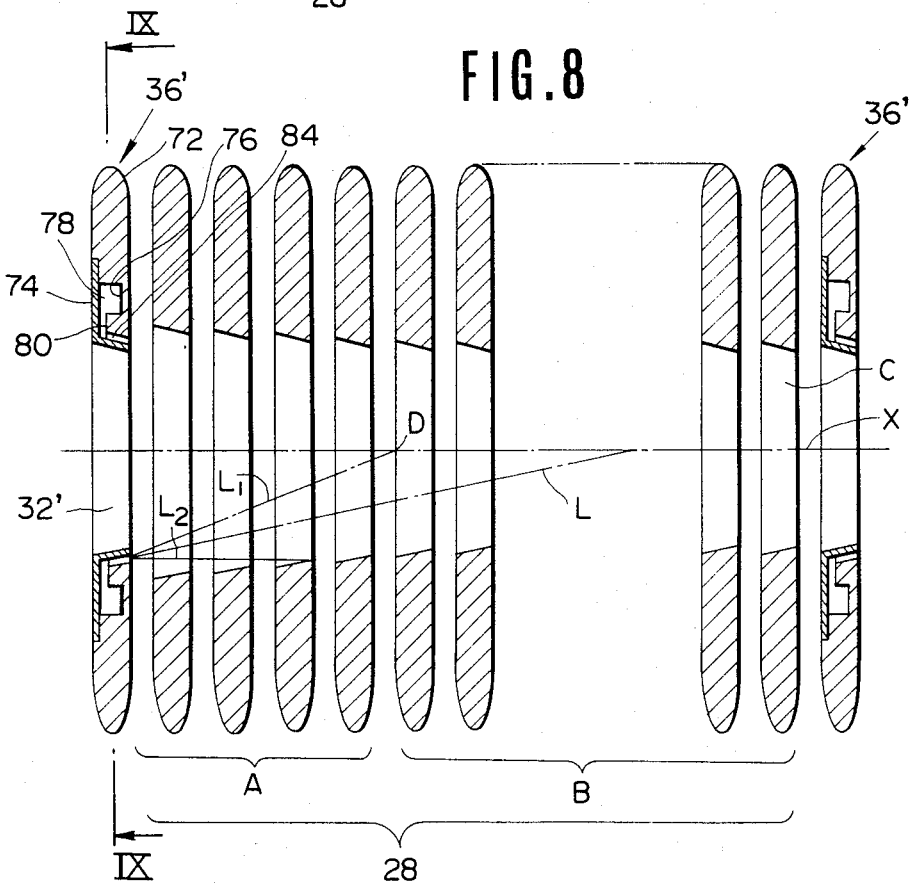
FIG. 8 is a sectional view similar to FIG. 7, but showing a second embodiment of the present invention.
Figure 9:
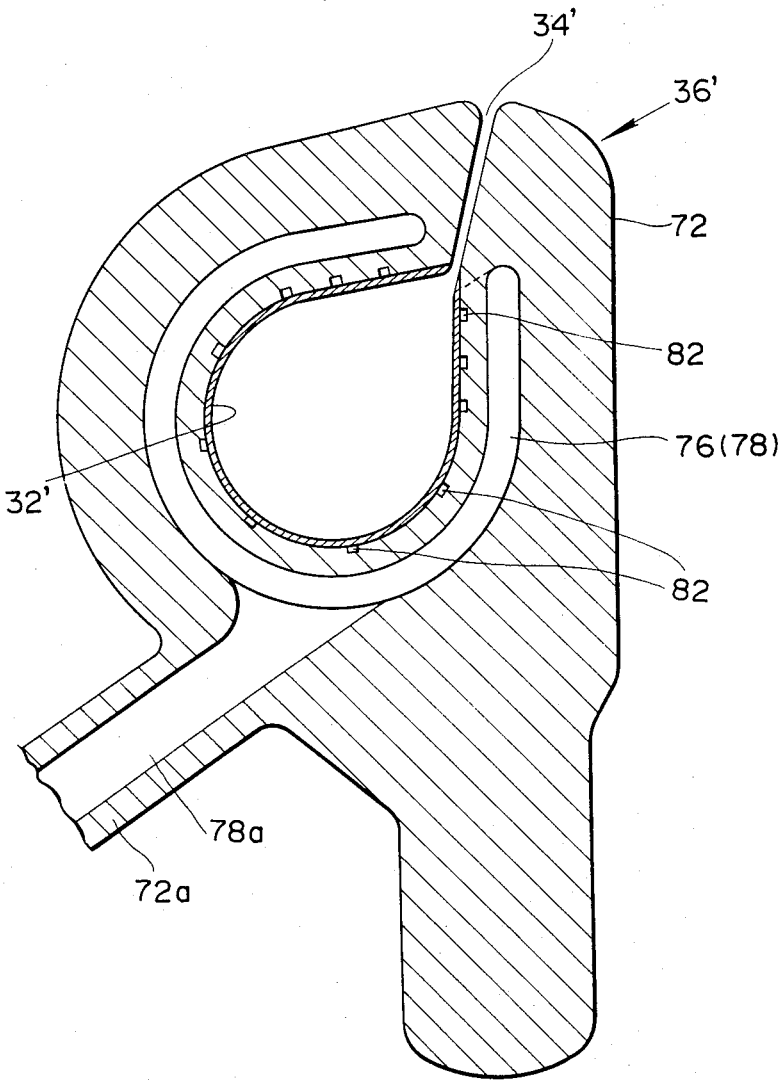
FIG. 9 is a sectional view taken along the line IX—IX of FIG. 8, showing another nozzle-mounted air guide member employed in the second embodiment.

Referring to FIGS. 8 and 9, there is shown a second embodiment of the present invention. The nozzle-mounted air guide member 36' employed in this second embodiment has, similar to the conventional nozzle-less air guide members 28, a straight arm and a curved arm (see FIG. 9) by which an air guide opening 32' is defined leaving a slit 34' between the leading ends of the arms. The air guide member 36' comprises a main body 72 and a flanged plate member 74 which are secured to each other by welding or the like. The main body 72 is formed with a semi-circular groove 76 around the air guide opening 32', so that upon assembly of the main body 72 and the flanged plate member 74, there is defined an enclosed semi-circular space or air passage 78 there-between. Similar to the nozzle-mounted air guide member 36 of the first embodiment, the air passage 78 is connected to the air transmitting connecting tube 68 (see FIG. 4) through a passage 78*a* formed in the extension 72*a* of the main body 72. As is seen from FIG. 8, the radially inward portion of the plate member 74 is separated from the main body 72 thereby to define therebetween a semi-circular slit 80 which extends around the air guide opening 32'. The inner peripheral wall of the main body 72 is formed with evenly spaced rectangular grooves 82, so that a plurality of air ejection holes 84 are defined between the inner peripheral wall and the frusto-conical flange portion of the plate member 74. It is to be noted that in the nozzle-mounted air guide member 36' of this second embodiment, the provision of the semicircular slit 80 between the semi-circular air passage 78 and the air ejection holes 84 brings about a desirable phenomenon. That is, before being ejected from the auxiliary nozzles 84, the compressed turbulent air flow in the semi-circular air passage 78 is compelled to flow in the semi-circular slit 80 radially inward, so that the air ejection from the auxiliary nozzles 84 can be set with accuracy.

The arrangement and construction of the other guide members 28 located downstream of the nozzle-mounted air guide member 36' are substantially the same as those of the first embodiment of FIG. 7. That is, these guide mbmers 28 consist of two groups of air guide members A and B, as shown in FIG. 8.

Referring to FIGS. 10, 11, 12 and 13, there is shown a third embodiment of the present invention. The nozzle-mounted air guide member 36 employed in this third embodiment is the same as the member 36 employed in the first embodiment of FIG. 7. Of course, the nozzle-mounted air guide member 36' employed in the second embodiment of FIG. 8 can be used in this third embodiment.

Similar to the afore-mentioned first and second embodiments, in the third embodiment, the air guide members 28 located downstream of the nozzle-mounted air guide member 36 consist of two groups of guide members A and B. Thus guide members of group B are the same as those of group B of the first embodiment of FIG. 7. The guide members of group A have substantially the same constructions as those of group A of the first embodiment except tongue members 86 provided thereto. In fact, as will be seen from FIG. 10, the air guide members 28" of group A other than the member 28' located just downstream of the nozzle-mounted air guide member 36 are all provided with tongue members 86. As is understood from FIG. 12, the tongue member 86 is integral with and extends from the inside wall of the curved arm 28"B toward the slit 34 to narrow the same. The top of the tongue member 86 is bent outwardly to facilitate the weft pass-out motion at the beating operation. If desired, as is seen from FIG. 13, the tongue member 86 may be a separate member which is bonded to the air guide member proper 28". (Now, if desired, the air guide members of group B may be also provided with tongue members.)

By the provision of the tongue members 86, the weft picking operation is more assuredly carried out than the case of the first or second embodiment. In fact, the provision of the tongue members 86 narrows the slits 34 thereby minimizing air leak therethrough upon weft picking.

DESCRIPTION OF TESTS

In order to check up the effects of providing the tongue members 86, several weaving-tests were carried out by the inventors. The test conditions and results will be described hereinnext with reference to FIG. 10.

The thickness of the nozzle-mounted air guide member 36 is about 3 mm, the number of the air ejection holes 62, of the member 36 is twenty five in total, twenty two of the holes 62 have diameters of about 0.5 mm, and remaining three of the holes 62 have diameters of about 0.8 mm. The pressure of the compressed air in the air supply source 42 is about 2.2 $Kg/cm^2$.

The thickness of each air guide member 28' or 28" of group A is about 2.8 mm, the diameter of the air guide opening of the guide member 28' is about 18 mm, and the diameters of the air guide openings of the four guide members 28" are about 17.25 mm, 16.5 mm, 15.75 mm and 15 mm, respectively. The angles of the tapered surfaces of the guide openings of the air guide members 28' and 28" with respect to the axis X of the air guide channel C are all about 12 degrees. The clearance defined between the tongue member 86 and the arm 28"A is about 0.2 mm. The diameters of the guide openings of the guide members 28 of group B are all about 14 mm, and the angles of the tapered surfaces of the guide openings of these guide members 28 with respect to the axis X of the air guide channel C are all about 7 degrees. For the tests, the loom resistered as NISSAN JET LOOM LA22-150 was used.

The tests carried out under the above-mentioned conditions revealed that the undesirable weft get-out phenomenon does not occur at all in three hour weaving operation.

What is claimed is:

1. A weft picking device of an air jet type weaving loom, having a plurality of air guide members which are aligned in the weft picking direction, each guide member having therein both a tapered air guide opening through which the weft yarn passes upon weft picking, and a slit through which the weft yarn passes out upon beating, the tapered surface of the air guide opening of each air guide member being tapered toward the weft picking direction, and wherein said plurality of air guide members comprises:

a nozzle-mounted air guide member having around the air guide opening thereof a plurality of air ejection holes from which compressed air is ejected in the weft picking direction to establish an auxiliary air flow;

a first group of air guide members located downstream of said nozzle-mounted air guide member and positioned between the nozzle-mounted air guide member and the point at which the inboard boundary of the auxiliary air flow from each air ejection hole intersects the axis of the air guide channel of the aligned air guide members, the air guide openings of the first group air guide members being larger than the air guide opening of said nozzle-mounted air guide member and gradually reduced in diameter as the distance from the nozzle-mounted air guide member increases; and a second group of air guide members located downstream of said first group of air guide members, the air guide openings of said second group air guide members being identical to one another and to the air guide opening of said nozzle-mounted air guide member.

2. A weft picking device as claimed in claim 1, in which the air guide opening of the upstreammost positioned one of the first group air guide members is sufficiently larger than that of the nozzle-mounted air guide member so that it encircles the air ejection holes of the nozzle-mounted air guide member.

3. A weft picking device as claimed in claim 1, in which the angle of each tapered surface of the first group air guide members with respect to the axis of the air guide channel is greater than that of the nozzle-mounted air guide member.

4. A weft picking device as claimed in claim 1, in which another nozzle-mounted air guide member, another first group of air guide members and another second group of air guide members are located in this order downstream of the previously mentioned second group of air guide members.

5. A weft picking device as claimed in claim 1, in which the top of each tongue member is bent outwardly to facilitate the weft pass-out motion upon beating operation.

6. A weft picking device as claimed in claim 2, in which two or three of the first group air guide members which are located just downstream and adjacent said nozzle-mounted air guide member have identical tapered air guide openings.

7. A weft picking device as claimed in claim 1, in which said nozzle-mounted air guide member, first group of air guide members and second group of air guide members are located at the downstream end of said plurality of air guide members.

8. A weft picking device as claimed in claim 3, in which the first group air guide members other than said upstreammost position air guide member are all provided with tongue members, each tongue member extending from the associated air guide member proper toward the slit to narrow the same.

9. A weft picking device as claimed in claim 8, in which said tongue member is integral with the associated air guide member.

10. A weft picking device as claimed in claim 2, in which the tapered surfaces defining the perimeters of the tapered air guide openings of the first group air guide members are generally parallel with the trajectory line along which the air flow from each air ejection hole is directed.

11. A weft picking device as claimed in claim 1, in which said nozzle-mounted air guide member has therein an air passage communicated with said air ejection holes, said air passage being connected to a compressed air source.

12. A weft picking device as claimed in claim 11, in which said nozzle-mounted air guide member has a dividable construction comprising an upstream located body and a downstream located body which are welded to each other, each body being formed with a recess so that upon assembly of the bodies, are enclosed space or air passage is defined in the assembled nozzle-mounted air guide member.

13. A weft picking device as claimed in claim 12, in which said downstream located body is formed with said tapered air guide opening.

14. A weft picking device as claimed in claim 13, in which said downstream located body is formed around said tapered air guide opening with the air ejection holes which are arranged at evenly spaced intervals.

15. A weft picking device as claimed in claim 14, in which said downstream located body is formed, at its downstream facing surface surrounding the smallest diameter portion of the tapered air guide opening, with a tapered surface to which the air ejection holes are exposed.

16. A weft picking device as claimed in claim 15, in which said tapered surface is inclined at generally right angles with respect to the axis of each air ejection hole.

17. A weft picking device as claimed in claim 11, in which said nozzle-mounted air guide member comprises a main body and a flanged plate member which are secured to each other, said main body being formed with a semi-circular groove around the frusto-conical air guide opening, so that upon assembly of the main body and the flanged plate member, a semi-circular enclosed space or air passage is defined in the assembled nozzle-mounted air guide member.

18. A weft picking device as claimed in claim 17, in which the radially inward portion of the flanged plate member is separated from the main body thereby to define therebetween a semi-circular slit which extends around the tapered air guide opening.

19. A weft picking device as claimed in claim 18, in which the inner peripheral wall of the main body is formed with evenly spaced rectangular grooves, so that, upon assembly of the main body and the flanged plate member, a plurality of the air ejection holes are defined between the inner peripheral wall and the tapered flange portion of the flanged plate member.

20. A weft picking device as claimed in claim 1, in which said tapered air guide opening of each guide member is shaped into a frusto-conical form.

* * * * *